US008695263B2

(12) United States Patent
Murray

(10) Patent No.: US 8,695,263 B2
(45) Date of Patent: Apr. 15, 2014

(54) SHELL DESTRUCTION TECHNIQUE

(75) Inventor: Christopher Charles John Murray, Moore Park (AU)

(73) Assignee: Applied Explosives Technology Pty Limited, Moore Park (AU)

( * ) Notice: Subject to any disclaimer, the term of this patent is extended or adjusted under 35 U.S.C. 154(b) by 0 days.

(21) Appl. No.: 13/189,426

(22) Filed: Jul. 22, 2011

(65) Prior Publication Data

US 2013/0000469 A1 Jan. 3, 2013

(30) Foreign Application Priority Data

Jul. 1, 2011 (AU) ..... 2011902625

(51) Int. Cl.
*F41A 21/00* (2006.01)

(52) U.S. Cl.
USPC ..... 42/75.03; 86/49; 86/50; 110/237; 110/342; 588/403

(58) Field of Classification Search
USPC ..... 86/49, 50; 110/237, 342–346; 588/403
See application file for complete search history.

(56) References Cited

U.S. PATENT DOCUMENTS

| | | | | |
|---|---|---|---|---|
| 3,282,743 | A * | 11/1966 | Holtzman | 29/421.2 |
| 4,862,804 | A * | 9/1989 | Chawla et al. | 102/309 |
| 6,536,348 | B1 * | 3/2003 | Gral | 102/293 |
| 6,647,851 | B2 * | 11/2003 | Donovan | 86/50 |
| 7,398,720 | B2 * | 7/2008 | Fujiwara et al. | 86/50 |
| 8,006,600 | B2 * | 8/2011 | Fujiwara et al. | 86/50 |
| 8,171,837 | B2 * | 5/2012 | Asahina et al. | 86/50 |
| 2009/0126555 | A1 * | 5/2009 | Olsson | 86/50 |
| 2012/0000390 | A1 * | 1/2012 | Heitmann | 102/520 |

OTHER PUBLICATIONS

"Appendix F: Explosive Destruction System Phase 1 (EDS-1) Overview and Description", *Evaluation of Alternative Technologies for Disposal of Liquid Wastes from the Explosive Destruction System*, Board of Army Science and Technology (BAST), 2001, www.nap.edu/openbook.php?record_id=10646&page=56.

Blades, Timothy A.; DiBerardo, Raymond; Misko, Gregory; McFarlene, Neil; "Demonstration/Validation of the TC-25 Donovan Blast Chamber, Porton Down, UK, Final Demonstration Test Report, Apr.-Sep. 2003" http://www.stormingmedia.us/73/7325/A732524.html.

* cited by examiner

*Primary Examiner* — Samir Abdosh
(74) *Attorney, Agent, or Firm* — Knobbe, Martens, Olson & Bear, LLP

(57) ABSTRACT

An explosive assembly adapted to destruction of artillery and other large ordnance shells; said explosive assembly comprising a pair of hollow half shells; each of said half shells formed with an internal cavity conforming to at least a portion of external surfaces of an ordnance shell to be destroyed.

4 Claims, 3 Drawing Sheets

SHELL DESTRUCTION TECHNIQUE

The present invention relates to the disposal of old ordnance and, more particularly, to the destruction of large artillery and tank ammunitions.

BACKGROUND

Many parts of the world remain littered with unexploded ordnance, posing a danger to civilians and in many instances impeding use of cropland. In addition, stockpiles of unused but now obsolete and in some cases, dangerous artillery and other large ordnance shells need to be disposed of.

Although in some cases such shells can be disarmed, this is often either dangerous, too time consuming and expensive to provide a practical solution.

It is known to destroy ordnance high explosive and chemical shells by subjecting them to a controlled explosion. See following document for a description of this process;

Demonstration/Validation of the TC-25 Donovan Blast Chamber, Porton Down, UK, Final Demonstration Test Report, April-September 2003

Authors: Timothy A. Blades; Raymond DiBerardo; Gregory Misko; Niel McFarlene; *EDGEWOOD CHEMICAL BIOLOGICAL CENTER ABERDEEN PROVING GROUND MD* http://www.stormingmedia.us/73/7325/A732524.html U.S. Pat. No. 6,647,851 to Donovan (published November 2003) describes the principles of wrapping a munition with an externally applied explosive material for the purpose of destroying the munition. The disclosure of U.S. Pat. No. 6,647,851 is incorporated herein by cross reference. FIG. 4 of that patent is reproduced in FIG. 1 of this specification as acknowledged prior art.

Typical methods as described in the documents quoted above are to enclose the shell in a quantity of malleable elastomeric or plastic explosive with a high detonation velocity and high detonation pressure, or to array a system of linear and conical shaped charges around the contained shell. In the case of detonating of the enclosing explosive, this detonation pulverizes the shell casing and either detonates the explosive material within or, in the case of a non explosive shell filling, for example sulphur or nitrogen mustard agent (well known WW 1 and WW2 chemical warfare agents), disperses and partially decomposes these agents, and similarly other chemical warfare agents such as lewisite and phosgene. It is to be noted that the above described procedure and effect is only conducted, in the case of ordnance shell (and other ordnance ammunition such as mortar shells, rocket warheads and bombs) containing chemical agent, in a specially constructed blast chamber. Such chambers are provided with suitable equipment designed to pyrolise, chemically react, and filter any chemical agent remnants so as to render these remnants harmless.

In addition, a shaped charge system for the destruction of chemical munitions is described by the Board on Army Science and Technology at http://www.nap.edu/openbook.php?record id=10646&page=56.

In this system, a munition to be destroyed is placed in a blast chamber and exposed to detonation of a combination of linear and conical shaped charges. The linear charge comprises a preformed length of RDX-based, copper-sheathed LSC (linear shaped charge) specific to the shape and length of the munition, and is designed to make a complete cut in the munition. Two conical shaped charges (CSC) are used to break open the burster charge canister in the munition and detonate the explosives.

Another method known in the industry is to surround the ordnance shell with a watergel or emulsion explosive, within a blast chamber, and detonate the said explosive. A relatively greater mass of the watergel or emulsion explosive is used for this task, compared to wrapping the shell with elastomeric sheet or plastic explosive. This is because the detonation pressure of the watergel or emulsion explosive is substantially lower than the detonation pressure and detonation velocity of the above described elastomeric or plastic explosive.

These methods of disposal while effective, are inefficient or complicated as well as being relatively time consuming. As well, explosive sheet is an expensive explosive in comparison to the above described watergel or emulsion explosives, and also compared to the present invention's preferred explosives, Hexolite or Pentolite or TNT. The United States is most probably the largest manufacturer of sheet elastomeric and malleable Plastic explosive although there are similar products made in Europe, Russia China and elsewhere—although, in each case, the product is relatively expensive compared to the cheap and abundant cast explosives, Hexolite and Pentolite or TNT, all of which are in common use for both the defence and mining industries in many countries. It should be noted that, especially in the Case of Pentolite and Hexolite, that their detonation velocities and pressures are more than adequate for the intended use, far superior to watergel or emulsion explosives, and slightly less effective than elastomeric or malleable explosives in terms of delivering shock energy to ordnance items as described. TNT is also more effective than emulsion or watergel explosives, and slightly less effective than either Pentolite or Hexolite, although sufficiently effective, and cheap, to be utilised in the intended role. For preference, Hexolite will be the most effective explosive for the intended purpose, although all three of these cast explosives will perform more than adequately.

Exemplary velocities of detonation of the explosives disclosed above are respectively as follows:

P2000 sheet (elastomeric) explosive—8200 meters/sec
C4 Plastic Explosive—8200 m/sec
Hexolite (60% RDX, 40% TNT)—7900 meters/sec
Pentolite (50% P.E.T.N, 50% TNT)—7400 meters/sec
T.N.T—6900 meters/sec
A.N (ammonium nitrate) Emulsion—5200 meters/sec
A.N Watergel—4200 m/sec There also tend to be export restrictions on, for example, Primasheet 2000 and C4 plastic explosive, specialised elastomeric, malleable explosives that could also be suitable for the disposal of munitions task because the US government regards RDX containing elastomeric and plastic explosives as a controlled export category product, as it is primarily for military use.

These products contain high percentages of RDX explosive (cyclo trimethylene trinitramine)

It is an object of the present invention to address or at least ameliorate some of the above disadvantages.

Notes

1. The term "comprising" (and grammatical variations thereof) is used in this specification in the inclusive sense of "having" or "including", and not in the exclusive sense of "consisting only of".

2. The above discussion of the prior art in the Background of the invention, is not an admission that any information discussed therein is citable prior art or part of the common general knowledge of persons skilled in the art in any country.

BRIEF DESCRIPTION OF INVENTION

Accordingly, in a first broad form of the invention, there is provided an explosive assembly adapted to destruction of artillery and other large ordnance shells; said explosive assembly comprising a pair of hollow half shells; each of said half shells formed with an internal cavity conforming to at least a portion of external surfaces of an ordnance shell to be destroyed.

Preferably, each said half shell is formed of a cast explosive material.

Preferably, each said half shell is formed as a non-explosive, rigid outer jacket provided with an internal layer of cast explosive material.

Preferably, said explosive material is hexolite or pentolite or TNT.

Preferably, said non-explosive, rigid outer jacket is moulded of fiberglass resin or other suitable, compatible resin or plastic material; said material being compatible with molten Hexolite or Pentolite or TNT; said material further able to withstand temperatures of up to 120 degrees centigrade.

Preferably, at least side surfaces of a said shell to be destroyed are enclosed by said half shells when placed around said shell to be destroyed; said explosive material then in close contact with said side surfaces.

Preferably, said explosive material is cast over a former having a shape conforming to a said ordnance shell to be destroyed.

Preferably, said former is a disarmed ordnance shell identical to said ordnance shell to be destroyed.

In another broad form of the invention, there is provided a method of forming an explosive assembly for destruction of artillery and other large ordnance shells; said method including the steps of:

(a) forming two hollow half shells; hollow cavities within said half shells conforming to external surfaces of an ordnance shell to be destroyed, (b) casting at least an inner layer of each of said hollow half shells from an explosive material.

Preferably, said hollow half shells include an outer jacket; said explosive material forming an inner lining of said outer jacket.

Preferably, said outer jacket is formed of fiberglass resin or other compatible resin or plastic material.

Preferably, said layer of explosive material is cast over a former; shape of said former conforming to external surfaces of an ordnance shell to be destroyed.

Preferably, said explosive material is hexolite or pentolite or TNT; said hexolite or pentolite or TNT heated to a fluidic state.

Preferably, said outer jacket is positioned over said former; said outer jacket provided with a number of entry points for introduction of predetermined quantities of said hexolite or pentolite or TNT in said flowable state; said hexolite or pentolite or TNT filling a void formed between an internal surface of said jacket and said external surfaces of said former.

In a further broad form of the invention, there is provided a method of destroying artillery shells and other large ordnance shells; said method including the steps of:

(a) enclosing a said ordnance shell in a pair of hollow half shells; each said half hollow shell comprising at least a layer of a cast explosive material, (b) detonating said cast explosive material.

Preferably, said layer of cast explosive material is in contact with at least side surfaces of said ordnance shell.

Preferably, cast explosive material is hexolite or pentolite or TNT.

Preferably, said layer of cast explosive material forms a layer within an outer jacket.

BRIEF DESCRIPTION OF DRAWINGS

Embodiments of the present invention will now be described with reference to the accompanying drawings wherein.

DETAILED DESCRIPTION OF PREFERRED EMBODIMENTS

First Preferred Embodiment

The present invention provides an efficient and cost-effective method of destroying unexploded ordnance shells. The method provides for substantially enclosing the shell in a cast layer of explosive in contact with the shell surface and detonating the layer within a blast containment structure.

Figure 1:
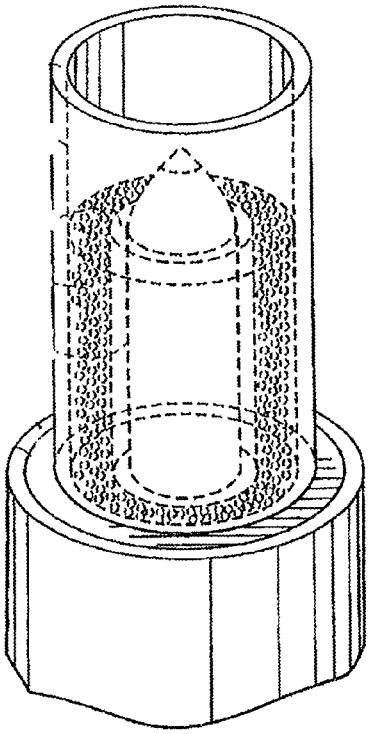
PRIOR ART Fig 1
FIG. 1 illustrates a prior art arrangement illustrated in U.S. Pat. No. 6,647,851
Figure 2:
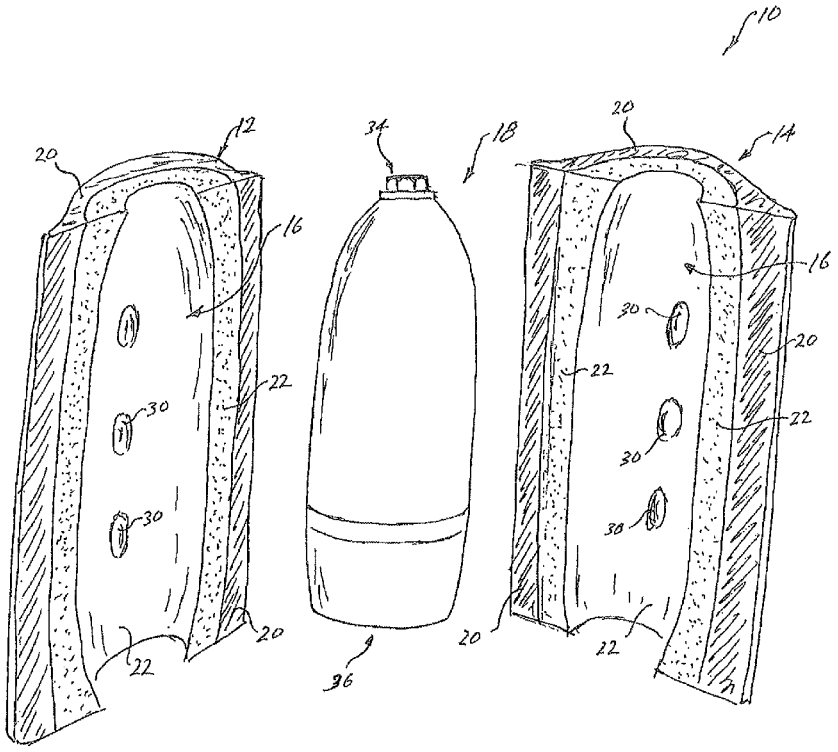
FIG. 2 is a separated view of an ordnance shell and the shells forming an explosive assembly according to a first preferred embodiment of the invention.
Figure 3:
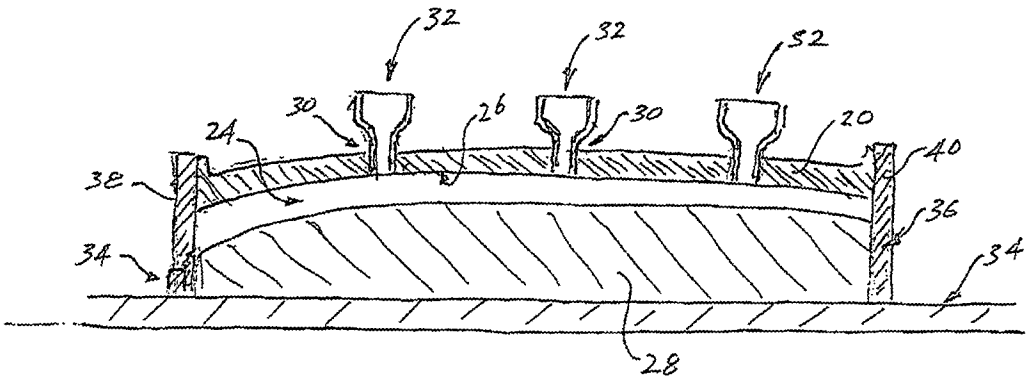
FIG. 3 is a sectioned view of a method of preparing the shells of the explosive assembly of FIG. 2.

In a first preferred embodiment of the invention, with reference to FIGS. 2 and 3, an explosive assembly 10 is comprised of a pair of hollow half shells 12 and 14, so formed that the hollow internal surfaces 16 conform closely to the side surface of an ordnance shell 18 which is to be destroyed. In this first preferred embodiment, the half shells comprise an outer jacket 20 and an inner layer 22 of an explosive material. Preferably the explosive material is hexolite, pentolite or TNT.

The outer jacket 20 is preferably formed of a fibreglass resin, or other suitable, compatible resin or plastic material, compatible in this context meaning that the material must be compatible with molten Hexolite or Pentolite or TNT as well as being able to withstand temperatures of up to 120 degrees centigrade.

The outer jacket is approximately of a similar, though considerably enlarged, shape as that of the ordnance shell for which the assembly is intended. This enlargement and the thickness of the jacket 20 are such as to leave a void (as shown in FIG. 3) between the inner surface 26 of the jacket 20 and a former 28 to form a layer of thickness appropriate to the calibre and characteristics of the ordnance shell for which the assembly is intended.

Entry holes 30, usually referred to as "risers" in the industry, are preferably three in number, and are provided along a side of the half jacket 20. These entry holes 30 are provided with filler cups 32 adapted to receive the explosive material and to accommodate shrinkage of the explosive material as it solidifies.

To cast the explosive layer within each jacket, a former 28 of identical shape to half the ordnance shell 18, (as split along its long axis), is supported on a flat surface 34, as shown in FIG. 3. Alternatively, the former 28 may be provided by a defused ordnance shell, suitably mounted in a shaped aperture in the surface 34 so that half of the ordnance shell projects above the surface.

The half jacket 20, prepared with the filler cups 32, is then placed centrally over the former 28. Depending on the type of ordnance shell, a transit cap 34 (as in the example of FIG. 2) may be left to project from the front of the jacket 20 if a defused shell is used as a former. As well, it is preferable, though not essential, that the base 36 of the ordnance shell be left uncovered by the explosive layer. For these reasons, baffles 38 and 40 are provided at the front and rear, sealing the spaces respectively between the former 28 and the outer jacket 20.

The explosive material is warmed to a temperature at which it becomes sufficiently fluidic to allow pouring a predetermined quantity into the void 24 between the outer jacket 20 and the inner former 28 to produce the desired explosive layer 22. After the explosive material has solidified and all shrinkage of the explosive material has occurred in the filler cups or "risers", the risers are detached from the half mould which is now filled with an homogenous mass of solidified explosive material. One half of the explosive assembly is now ready for use with the layer of explosive material bonded to the inside surface of the outer jacket.

The opposite half shell of the explosive assembly is produced in like manner. A booster and suitable detonator or detonating cord assembly (not shown is placed either at the nose of the completed cast explosive/shell assembly or attached to the sides of the assembly where explosive material is exposed at the entry holes 30 after removal of the filler cups 32.

To handle the destruction of a large number of ordnance shells, clearly a large number of explosive assemblies need to be produced. To this end the process lends itself to automation, for example the outer jackets may be injection moulded or vacuum formed from a suitable polymer. Jackets can be placed, for example by a pick and place or industrial robot station onto a conveyor of formers. The introduction of the explosive material may also be performed by an automated dispenser, such as for example a Meissner filling machine. The conveyor is of a length and with sufficient formers for the explosive material to solidify, so that at the end completed half shells may be removed for subsequent use at an ordnance shell destruction facility.

Second Preferred Embodiment

In a second preferred embodiment of the invention, ordnance shells are again destroyed by encasing the ordnance shell in an explosive assembly made up of pair of hollow half shells. In this embodiment however, there is no outer casing and the hollow half shells are formed solely of the explosive material, cast into the shape as described above.

To form these explosive material shells, an element similar to the outer jacket described above provides an outer former. Whereas in the first preferred embodiment above, the explosive material bonds to the outer jacket, in the present embodiment the outer former's inner surface is coated with a suitable release agent to prevent bonding.

In other respects, the process of forming the explosive assemblies of the second embodiment is similar to that of the first embodiment. Once the explosive material has solidified, the outer former is removed and the shell of explosive material removed from the inner former. It will be understood that this process also may be readily automated to handle a large volume of ordnance shells.

In Use

In use, the two halves of the explosive assembly are secured around the ordnance shell to be destroyed. Velcro straps may be attached to the halves of the assembly or the assembly my simply be taped around the shell. Suspension straps may also be attached for placement in the blast containment chamber. The assembly with the shell is then placed in a blast containment structure for detonation.

With a suitable layer of explosive material enveloping an ordnance shell, the explosive assembly of the invention completely pulverizes the shell's casing and either detonates its contents (if the contents are explosive), or vapourises and partially decomposes the contents if the contents are non-explosive, as is the case with chemical and smoke fillings for artillery shells and mortar shells or bombs or other projectiles or bombs. The blast chamber may also have a filter and absorption system attached to absorb, react with and decompose chemical agents such as mustard gas, lewisite and phosgene as well as V agents such as Sarin and Tabun.

The above describes only some embodiments of the present invention and modifications, obvious to those skilled in the art, can be made thereto without departing from the scope of the present invention.

The invention claimed is:

1. A method of destroying artillery, shells and other large ordnance shells; said method including the steps of:

(a) casting an explosive material into a rigid jacket of a hollow half shell; said casting forming an inner surface conforming to at least a portion of an outer surface of a said artillery shell of large ordnance shell, (b) enclosing a said artillery or large ordnance shell in a pair of said hollow half shells, (c) detonating said cast explosive material within said pair of said hollow half shells so as to destroy said artillery or large ordnance shell.

2. The method of claim 1 wherein said layer of cast explosive material is in contact with at least side surfaces of said ordnance shell.

3. The method of claim 1 wherein said cast explosive material is hexolite or pentolite or TNT.

4. The method of any one of claim 1 wherein said layer of cast explosive material forms a layer within an outer jacket.

* * * * *